US012358664B2

(12) United States Patent
Morgan et al.

(10) Patent No.: US 12,358,664 B2
(45) Date of Patent: Jul. 15, 2025

(54) SYSTEM AND METHOD FOR SEALING CONTAINERS

(71) Applicant: ISHIDA EUROPE LIMITED, Birmingham (GB)

(72) Inventors: David Morgan, Bournemouth (GB); Ben Hall, Poole (GB)

(73) Assignee: ISHIDA EUROPE LIMITED, Birmingham (GB)

( * ) Notice: Subject to any disclaimer, the term of this patent is extended or adjusted under 35 U.S.C. 154(b) by 39 days.

(21) Appl. No.: 18/023,081

(22) PCT Filed: Aug. 27, 2021

(86) PCT No.: PCT/GB2021/052230
§ 371 (c)(1),
(2) Date: Feb. 24, 2023

(87) PCT Pub. No.: WO2022/043703
PCT Pub. Date: Mar. 3, 2022

(65) Prior Publication Data

US 2023/0348123 A1 Nov. 2, 2023

(30) Foreign Application Priority Data

Aug. 27, 2020 (GB) ..... 2013452

(51) Int. Cl.
*B65B 7/01* (2006.01)
*B65B 7/16* (2006.01)
(Continued)

(52) U.S. Cl.
CPC ..... *B65B 7/164* (2013.01); *B65B 7/165* (2013.01); *B65B 31/028* (2013.01)

(58) Field of Classification Search
CPC ..... B65B 7/01; B65B 7/164; B65B 7/2878
(Continued)

(56) References Cited

U.S. PATENT DOCUMENTS 5,779,050 A * 7/1998 Kocher ..... B65B 7/2885 206/497
9,003,745 B2 * 4/2015 Capriotti ..... B29C 66/8227 53/329.2
(Continued)

FOREIGN PATENT DOCUMENTS

AU 2014 364 722 B2 4/2019
EP 2 441 683 A1 4/2012
(Continued)

OTHER PUBLICATIONS

International Search Report and Written Opinion of the International Searching Authority issued in PCT International Application No. PCT/GB2021/052230 mailed Mar. 21, 2022.
(Continued)

*Primary Examiner* — Thanh K Truong
*Assistant Examiner* — Patrick B Fry
(74) *Attorney, Agent, or Firm* — SQUIRE PATTON BOGGS (US) LLP

(57) ABSTRACT

A container has a product in a product-receiving area and has a sealing area surrounding the product-receiving area. A length of film is arranged over the container. A space above the film is evacuated using an evacuating portion of an upper sealing module arranged over the film, so as to cause a portion of the film to conform to the upper sealing module. An area of the film is cut out by moving a cutting tool relative to the upper sealing module from a recessed position to a cutting position. The cut-out area of film includes the portion of the film conformed to the upper sealing module, is brought into contact with the sealing area of the container by moving the upper sealing module relative to the container, and is sealed to the sealing area of the container using a heat sealing portion of the upper sealing module.

19 Claims, 6 Drawing Sheets

(51) Int. Cl.
*B65B 7/28* (2006.01)
*B65B 31/02* (2006.01)

(58) Field of Classification Search
USPC ..... 53/329.3
See application file for complete search history.

(56) References Cited

U.S. PATENT DOCUMENTS

| | | | | |
|---|---|---|---|---|
| 11,034,474 | B2 * | 6/2021 | Harrison | B29C 65/18 |
| 2003/0196412 | A1 * | 10/2003 | Foulke, Jr. | B65B 11/52 53/329.3 |
| 2007/0022717 | A1 * | 2/2007 | Seggern | B29C 66/112 53/511 |
| 2008/0148690 | A1 | 6/2008 | Von Seggern | |
| 2017/0305586 | A1 * | 10/2017 | Rizzi | B29C 66/73715 |
| 2020/0079537 | A1 * | 3/2020 | Shu | B65B 7/168 |
| 2020/0324492 | A1 * | 10/2020 | Morgan | B29C 66/53461 |

FOREIGN PATENT DOCUMENTS

| | | | |
|---|---|---|---|
| EP | 2 722 281 | A2 | 4/2014 |
| EP | 2 815 983 | A1 | 12/2014 |
| JP | 2011 116375 | A | 6/2011 |
| WO | WO 2016/055598 | A1 | 4/2016 |
| WO | WO 2018/193382 | A1 | 10/2018 |
| WO | WO 2018/193383 | A1 | 10/2018 |

OTHER PUBLICATIONS

Search Report for GB2013452.4, dated Jan. 22, 2021.

* cited by examiner

SYSTEM AND METHOD FOR SEALING CONTAINERS

CROSS-REFERENCE TO RELATED APPLICATIONS

This application is a national-stage filing under 35 USC 371 (c) of International Application No. PCT/GB2021/052230, filed Aug. 27, 2021, which claims priority to, and the benefit of, Great Britain Patent Application GB 2013452.4 filed Aug. 27, 2020, the entire contents of each of which are herein incorporated by reference in their entirety for all purposes.

FIELD OF THE INVENTION

The present invention relates to methods and systems sealing a container with a film cover. In particular, the invention relates to methods and systems for skin sealing food products in containers such as skin-sealed trays or substantially flat sheets.

BACKGROUND TO THE INVENTION

Products that degrade when exposed to air, such as food products, may typically be packaged in one of two ways in order to extend their shelf life. A first means of packaging such products is to modify the atmosphere in which the product is stored in the container, i.e. modified atmosphere packaging (MAP). An alternative way of packaging such products is to minimise the amount of air included in the packaging with the product and one specific technique for doing this is a so-called "skin seal" packaging technique. In skin sealing, a product is typically provided on a container (or support), such as a tray or flat sheet, and a film is held in place over the container while a vacuum is drawn around the product and container. The film is sealed to the container and then the film is released and the resulting vacuum inside the container draws the film into conforming to the shape of the product.

In particular in skin sealing, the film is typically held in place over the container by first drawing a vacuum above the film so that film conforms to an upper sealing module. This may allow a vacuum to subsequently be drawn on the container below the film. Outside of skin sealing this holding technique could also allow a modified atmosphere to be generated below the film. A problem associated with this technique is that the film is typically sealed to the container and then subsequently cut out from a continuous web of film by cutting around the container. This is known as an "outside cut", in which the film extends slightly beyond the periphery of the container. It would be desirable to enable a so-called "inside cut", in which the film is slightly smaller than the container to which it is sealed, to be achieved with these sealing techniques.

SUMMARY OF THE INVENTION

In accordance with a first aspect of the invention, a method of sealing a container with a film cover comprises: providing a container having a product in a product-receiving area of the container and having a sealing area of the container surrounding the product-receiving area; arranging a length of film over the container; and then, in order, using an upper sealing module arranged over the film, evacuating a space above the film using an evacuating portion of the upper sealing module so as to cause a portion of the film to conform to the upper sealing module; using a cutting tool, cutting out an area of the film by moving the cutting tool relative to the upper sealing module from a recessed position to a cutting position, wherein the cut-out area of film includes the portion of the film conformed to the upper sealing module; bringing the cut-out area of film into contact with the sealing area of the container by moving the upper sealing module relative to the container (i.e. in the direction towards the container); and sealing the cut-out area of film to the sealing area of the container using a heat sealing portion of the upper sealing module.

In this technique, the film is cut before it is sealed to a contained. This will typically be performed using a rapid stroke containing two main phases: a first phase in which the cutting tool cuts the film and a second phase in which the sealing tool advances the cut out piece of film relative to the container in order to make the seal. By performing this two phase motion, the film can be cut slightly smaller than the container to which it will be sealed, to minimise or avoid loose edges of the film from extending beyond the periphery of the container. One particular challenge with implementing this two phase motion consisted in the fact that the film must first be drawn upwards onto the sealing module as the vacuum is generated above the film. Since the cutting tool is provided in the vicinity of the upper sealing module, this drawing of the film onto the sealing module could also cause the film to be cut or damaged by the cutting tool, which in turn may prevent an effective vacuum being drawn above the film. To prevent such damage to the film, the cutting tool is provided initially recessed relative to the upper sealing module and is movable relative to the upper sealing module in order to cut the film once the container is ready to be sealed.

It should also be noted that, in the cutting and sealing stroke, the cutting tool will initially advance relative to the sealing module so as to move from the recessed position to the cutting position, i.e. in which the cutting tool will typically project beyond the sealing module. This relative movement will typically be achieved by moving the cutting tool while holding the upper sealing module stationary, but it is also envisaged that the upper sealing module (to which the film is conformed) could initially move, e.g. in the direction away from the container, while the cutting tool is held stationary in order cause the film to be cut by the cutting tool. Indeed, in some embodiments, the lower sealing module, the upper sealing module and possibly other parts of the upper tool may move together relative to the substantially stationary cutting tool in order to generate this initial movement phase of the cutting tool. In the more typical case in which the cutting tool moves towards the container, the upper sealing module may be stationary, but could also be advancing towards the container. If the upper sealing module is also advancing towards the container, the cutting tool must move faster than the upper sealing module in order to advance from the retracted position to the cutting position. In the second phase of movement, the upper sealing module brings the cut-out area of film into contact with the sealing area of the container. In the second phase, the cutting tool may be stopped or slowed relative to the lower sealing module, so that the sealing module once again advances past the cutting tool and so that the cutting tool does not also contact the container. Avoiding contact between the cutting tool and the container is advantageous since it may avoid damaging the container and affecting its appearance and it may also prevent the cutting tool from being gradually blunted by repeated contact with containers.

The present method is suitable for packaging any product, but is particularly suited to packaging food products such as meat, poultry and fish products. The method is also particularly preferably implemented as a method of skin sealing a product in a container with a film cover, but can also be used in other contexts, such as modified atmosphere packaging.

Particularly preferred types of container include a tray and a flat sheet. Where the container is a tray, the tray will typically comprise a rim that extends around the periphery of the bowl of the tray. The product will be placed in the bowl of the tray and the film sealed along the rim of the tray. Trays are suitable for both modified atmosphere packaging and skin sealing, although relatively shallow trays are preferred for skin sealing to improve the aesthetics of the final packaged product. For example, the depth of the tray may be less than the thickness of the product being packaged. The container may also be a flat sheet, such as a sheet of plastic. This type of container is suited to skin sealing. Where a flat sheet is used, the product will be placed in an area of the sheet, e.g. near the centre, and the film sealed to the sheet around the product. In other words, the sealing area may be any part of the sheet surrounding the product, this area being referred to as the "border area" of the sheet. In some methods, the film may be sealed along the periphery of the sheet, but in others it may be preferred to form the seal around the product so as to leave substantial portions of the sheet uncovered by film, e.g. to receive labels, stickers and the like.

In particular in skin sealing techniques, the method further comprises heating the film before and/or during the step of evacuating the space above the film, wherein preferably the evacuating portion of the upper sealing module comprises a heater plate for heating the film. Firstly, this assists with the conforming of the film to the upper sealing module, as the film is able to deform, and this then allows the film to be firmly held in place while, for example, a vacuum is drawn beneath the film. Secondly, this heating helps the film conform to the product in a skin sealing process. It is envisaged that, in some embodiments, the method may not involve heating the film, e.g. if the shape of the sealing module means that not much deformation of the film is required or if the film is readily deformable at low temperatures. As noted above the preferred manner of heating the film is by providing that the evacuating portion comprises a heater plate. For example, the sealing module may comprise a generally concave and/or dome-shaped plate having a plurality of apertures therethrough for communicating vacuum suction to the space above the film, said plate being heatable to deform the film as the vacuum is applied.

In many embodiments, the method further comprises, after evacuating the space above the film, evacuating the space below the film using an evacuating portion of a lower sealing module, said space below the film including the container, and further comprising sealing the cut-out area of film to the sealing area of the container while the space below the film is evacuated. In these embodiments, a vacuum is drawn in the space below the film, which includes the container and the product in/on the container and the film is sealed to the container in these vacuum conditions. This process seals the product in the container substantially without the presence of any air. If the process is a skin sealing process, then this vacuum inside the container may be used to cause the film to contract over the product in the container and form the skin seal. In particular, the method may comprise releasing the vacuum formed in the space above the film after the film has been sealed to the container such that the heated film substantially conforms to the product in the container.

In many embodiments, the container is held during sealing by a holding portion of a lower sealing module. The holding portion may hold the container during the sealing process and prevent lateral movement of the container. The holding portion may comprise a supporting portion that supports the sealing area of the container. That is, during sealing, the sealing portion of the upper sealing module will typically be pressed down against the sealing area of the container and it is preferable that the sealing area of the container be supported during this sealing in order to firmly seal the film to the container. Using the arrangement described above, the sealing area of the container is effectively clamped between said supporting portion of the lower sealing module and the sealing portion of the upper module in order to ensure full contact between the film and the sealing area of the container along the entire length of the seal.

Typically, the upper sealing module and cutting tool are mounted in an upper sealing tool. This upper sealing tool may support the upper sealing module and the cutting tool in a sealing system. Likewise, the lower sealing module may be mounted in a lower sealing tool. Each upper sealing tool may comprise only one upper sealing module and cutting tool, and each lower sealing tool may comprise one corresponding lower sealing module (i.e. a complete cutting and sealing module), but in many embodiments, each upper sealing tool will comprise a plurality of upper sealing modules and corresponding cutting tools and each lower sealing tool will comprise a corresponding plurality of lower sealing modules (i.e. defining a plurality of cutting and sealing modules) so that the above described sealing process can be performed in each cutting and sealing module, typically simultaneously.

During the sealing process, preferably the film is clamped to the upper sealing tool by a clamping plate, thereby defining an enclosed space above the film for said evacuating portion to evacuate. In particular, the upper sealing tool may define one or more lateral openings within which the or each upper sealing module and cutting tool are located and the clamping tool may then clamp the film along the perimeter of the or each lateral opening. Thus, the evacuating portion may effectively evacuate the space above the film while it is clamped to the upper sealing tool. Preferably the clamping plate has an aperture through which at least the upper sealing module can pass to bring the film into contact with the sealing area of the container. Typically the aperture will also be sized so that the cutting tool can pass at least part way through the aperture and towards the container. This range of motion for the cutting tool may help ensure that a clean and complete cut of the film is made by the cutting tool. However, as noted above, it is typically desirable that the cutting tool does not advance all the way to the container, as contact between the cutting tool and the container can damage the container and also gradually blunt the cutting tool. Therefore, the cutting tool may not require to pass completely through the aperture of the clamping plate. While it is preferred that the clamping plate have an aperture for the upper sealing module, it is also envisaged that the clamping plate could be removed once the space above the film is evacuated and the film is held under vacuum pressure against the upper sealing module.

As mentioned above, the lower sealing module may be mounted in a lower sealing tool, and in some embodiments the lower sealing tool may be clamped to the clamping plate, thereby defining an enclosed space below the film. That is, the lower sealing tool may define one or more lateral openings respectively within which the or each lower sealing module is located and the lower sealing tool may then be clamped to the clamping plate to form a substantially air tight seal around the perimeter of the opening(s) in the lower tool. Alternatively, the clamping plate may be a part of the lower sealing tool such that the film is clamped to the upper sealing tool by the lower sealing tool, thereby defining an enclosed space below the film. Thus, an evacuating portion of the lower sealing module may draw a vacuum that encompasses the product in the container. This is particularly useful for skin sealing.

In embodiments in which the upper sealing module is located in an upper sealing tool, in the recessed position the cutting tool may be recessed with respect to a lower face of the upper sealing tool and the upper sealing module such that a blade of the cutting tool is retracted away from the film during evacuation of the space above the film. In these embodiments, the lower surface of the sealing module and the perimeter of the upper sealing module are separated by a gap, within which the cutting tool is recessed, which ensures that the film is not drawn into contact with the cutting tool as the space above the film is evacuated.

The present invention is particularly useful for allowing containers to be sealed with an "inside cut", described above, and so preferably the blade of the cutting tool is used to cut the film along a cutting profile (i.e. the path along which the film is cut), said cutting profile defining a smaller lateral area than the lateral area of the container to be sealed. For example, if the container is a tray with a rim to which the film is sealed, then the cutting profile of the cutting tool will be slightly smaller that outer perimeter of the tray rim. The cutting profile should, however, be larger than the inside perimeter of the tray rim if the film is to be sealed to the rim.

Typically, a blade of the cutting tool surrounds the upper sealing module such that the area of film is cut out by relative movement of the cutting tool along a direction substantially perpendicular to the film. This enables cutting and sealing to be performed by moving the cutting tool and sealing module respectively along the same single direction. However, this is not essential and the blade of the cutting tool could require some lateral movement as well to cut around the sealing module.

As mentioned above, typically, moving the cutting tool relative to the upper sealing module comprises moving the cutting tool relative to the container, e.g. towards the container, and preferably the upper sealing module remains substantially stationary relative the container while the cutting tool moves relative to the upper sealing module. Further preferably, the movement of the cutting tool relative to the container is stopped before the blade of the cutting tool contacts the container. As mentioned above, this prevents the container from being damaged and the blade from blunting. It will be clear from the above that the cutting and sealing stroke comprises at least two phases, movement of the cutting tool relative to the sealing module in order to move to the cutting position and then movement of sealing module relative to the lower sealing module to bring the film into contact with the container. However, other movement phases may also be used, e.g. a middle movement phase in which the cutting tool and the sealing module move together towards the container, which may ensure the film has been completely cut while beginning to advance the film towards the container. This may provide a faster cutting and sealing stroke, since the module does not need to wait for the cutting tool to stop before beginning to advance towards the container.

In many embodiments, the heat sealing portion of the sealing module surrounds the evacuating portion such that the cut-out area of film is simultaneously sealed along the entire sealing area of the container. This is not essential; however, and in other embodiments, the upper sealing module may only partially seal along the sealing area of the container, with the seal being completed subsequently. This may require the container to be held under vacuum until another sealing portion completes the seal.

The cutting tool and upper sealing module may be independently driven, with the timing of the separate drive actions being controlled to achieve the required relative motion over a complete cut and seal stroke. However, it is preferable if a single drive source can be used to move both the cutting tool and the upper sealing module relative to each other and the container. In order for a single drive source to cause the necessary relative motion, the upper sealing module and cutting tool cannot both be fixedly coupled to the same drive element. By drive element, we mean the element which is driven to move relative to other parts of the upper tool and/or relative to a frame of the sealing system, e.g. by being acted upon by a drive, such as a pneumatic actuator. In some embodiments, the upper sealing module and the cutting tool are each movably mounted on or relative to a common drive element, wherein movement of the drive element from a first position to a second position, preferably along a single direction from the first position to the second position (e.g. the drive element having a single movement axis), causes the cutting tool to move from the retracted position to the cutting position, e.g. in a first movement phase while the upper sealing module remains substantially stationary, and causes the upper sealing module to move towards the container for sealing the cut out area of film to the container. For example, the common drive element may be a movable shaft, movable relative to a fixed lower face of the upper tool in order to move both the cutting tool and the upper sealing module out from the upper tool. Alternatively, the common drive element may be a movable lower face of the upper tool moved relative to a fixed shaft within the upper tool, with movement of the lower face causing the cutting tool and the upper sealing module to again move out from the upper tool for cutting the film and contacting the container.

In particular, the upper sealing module and the cutting tool may each be movably mounted on or relative to the common drive element so that they have different movable ranges, such that movement of the drive element from the first position to the second position causes at least one phase of relative movement between the upper sealing module and the cutting tool. This may comprise a first movement phase in which the cutting tool advances in the direction towards the container relative to the upper sealing module, and then a second movement phase, in which the upper sealing module advances in the direction towards the container relative to the cutting tool owing to the movement of the common drive element. For example, the cutting blade may initially move with the drive element as it moves from the first position towards the second position, before a restriction to the movable range of the cutting tool prevents the cutting tool from continuing to move beyond the cutting position with the drive element. On the other hand, the upper sealing module may initially not move with the drive element as the drive element moves from the first position towards the second position owing to a restriction to its movement range, before beginning to move partway through the movement of the drive element from the first position to the second position. One way of achieving this is to provide that, the upper sealing module and the cutting tool are each movably mounted relative to the common drive element using resilient couplings, such as springs, and by providing that the cutting tool and the heat sealing module have different movable ranges relative to one another and relative to the common drive element. Resilient couplings may deform as the drive element moves when the movement of either the cutting tool or upper sealing module is otherwise restricted, thus permitting relative movement between the drive element and the cutting tool or upper sealing module, and hence relative movement between one another.

The common drive element, which may be a support member or carriage, may be configured to move relative to, for example, a frame of the sealing system, being driven by a drive means, such as a pneumatic actuator. In a first position of the common drive element, the drive element may be spaced away from the upper sealing module and/or connected to the upper sealing module via one or more resiliently deformable couplings. Preferably, the upper sealing module is mounted via one or more resiliently deformable couplings, at least one of which is resiliently deformed while the common drive element is in the first position so as to act to urge the upper sealing module in the direction away from the lower sealing module during a first movement phase as the common drive element moves from the first position to the second position. When referring to "resiliently deformed couplings" here, it is meant that they are deformed by more than simply the weight of the elements they are connecting. For example, resiliently deformed couplings connecting the upper sealing module within the upper tool may be urging the upper sealing module away from the lower sealing module, but this movement may be prevented by one or more stopping elements, which inhibit the movable range of upper sealing module. Alternatively, the upper sealing module may not be connected directly to the common drive element, such as by being connected to the upper sealing tool by resiliently deformable couplings and being spaced from the common drive element when it is in the first position. As will be described below, this connection arrangement may provide that initial movement of the common drive element does not move the upper sealing module relative to the lower sealing module, thereby allowing the cutting tool to advance from its retracted position.

At the first position of the common drive element, the common drive element may be connected to the cutting tool via one or more resiliently deformable couplings, i.e. so that movement of the common drive element will cause movement of the cutting tool relative to the upper sealing module. If the cutting tool is mounted via one or more resiliently deformable couplings, said resiliently deformable couplings may be substantially un-deformed in the first position. As will be described below, this may be because the cutting tool is intended to stop moving before the common drive element, and so these resilient couplings may be resiliently deformed later in the movement cycle, once the cutting tool has reached the end of its movable range.

With the construction described above, as the common drive element moves from its first position to a second position, this may cause relative movement of the cutting tool and the upper sealing module in a first phase of the movement, e.g. the upper sealing module may remain substantially stationary relative to a moving cutting tool, or the upper sealing module may move in the direction away from the lower sealing module while the cutting tool remains substantially stationary. This may be because the common drive element has to move a predetermined distance before it engages the upper sealing module, or because resiliently deformed couplings connecting the upper sealing module relative to the common drive element continue to urge the upper sealing module away from the lower sealing module as the common drive element moves. If the upper sealing module is mounted within the upper tool by resiliently deformed couplings in which the deformation is caused by a restriction to the movable range of the upper sealing module, the force exerted by the resilient coupling will reduce during said movement of the common drive element in the first movement phase until the upper sealing module begins to move towards the lower sealing module.

Concurrently, the movement of the common drive element from the first position to the second position may cause, in the first phase of the movement, the cutting tool to move towards the lower sealing module, e.g. there may be substantially no relative movement between the common drive element and the cutting tool, and so the cutting tool may be driven to perform the cutting of the film. The cutting tool may continue to move with the common drive element until one or more stopping elements inhibit further movement of the cutting tool during a second movement phase, e.g. and cause the resilient couplings to begin to be resiliently deformed. Preferably, the one or more stopping elements engage a support member or carriage of the cutting tool, which carries the blade of the cutting tool to prevent any unwanted forces from acting on the blade itself. Further preferably, the cutting tool is mounted via one or more resilient couplings which resiliently deform as the common drive element moves during the second movement phase and movement of the cutting tool is inhibited by the one or more stopping elements. The system is thereby able to generate initial movement of the cutting tool towards the container and relative to the upper sealing module, and subsequent movement of the upper sealing module towards the container and relative to the cutting tool with only one continuous direction of movement from the common drive element. This enables the common drive element to, in one movement, cause a cut-and-then-seal stroke.

Further preferably, the common drive element is connected to the upper sealing tool via one or more resilient couplings, preferably arranged to be resiliently deformed as the common drive element moves from the first position to the second position, and thus provide a restoring force for returning the common drive element to the first position.

As mentioned above, each of the cutting tool and the upper sealing module are preferably connected so as to be movable relative to the common drive element via one or more resilient couplings, and the common drive element may be connected to the upper sealing tool by one or more resilient couplings. Preferably, each resilient coupling comprises a spring.

Preferably, arranging a length of film over the container comprises unwinding film from a supply spool, and wherein preferably the method comprises winding waste film not cut out by the cutting tool onto a take-up spool. The use of film unwound from a supply spool is preferred since film can be supplied quickly and this allows in particular for the process to be performed by different modules located at different locations along the film web.

According to a second aspect of the invention, there is provided a system for sealing a container with a film cover comprising: a lower sealing module configured to receive a container to be sealed in a holding portion; a film transport system configured to arrange a length of film over the container received in the lower sealing module; an upper sealing module comprising an evacuating portion and a heat sealing portion, the evacuating portion being configured to evacuate a space above the film so as to cause a portion of the film to conform to the upper sealing module and the heat sealing portion being configured to heat seal the film to a container received in the lower sealing module so that the seal surrounds a product-receiving area of the container; and a cutting tool configured to cut around the upper sealing module so as to cut out an area of the film including the portion conformed to the upper sealing module for sealing to the container, wherein the cutting tool is movable relative to the upper sealing module between a retracted position and a cutting position; wherein the cutting tool and the upper sealing module are each movable relative to (e.g. towards) the lower sealing module, wherein in a first movement phase the cutting tool is movable relative to (e.g. towards) the lower sealing module and movable from the retracted position to the cutting position for cutting out the area of film, and in a second movement phase (after the first movement phase) the upper sealing module is movable relative to (e.g. towards) the lower sealing module for sealing the film to the container.

This aspect provides a system that is, in particular, suitable for performing the method according to the first aspect of the invention. It will be appreciated that each of the preferred features described above may likewise be implemented in the context of this system. Some preferable features are described in more detail below.

This system may be used to perform the sealing types described above and in particular can advantageously be used to perform a skin seal with an "inside cut" of the film cover. This is possible by having the cutting tool and the sealing tool at the same position in the system so that the film can be cut immediately before it is sealed to the container, and the retractable nature of the cutting tool ensures that the film is not damaged when a vacuum is drawn in the space above the film as the module prepares to perform a cutting and sealing stroke.

As described above, preferably the evacuating portion of the upper sealing module comprises a heater plate for heating the film before and/or during evacuation of the space above the film. This facilitates deformation of the film, both as it is drawn on to the upper sealing module and, in skin sealing processes, as it conforms to the product after it is sealed to the container under vacuum.

Preferably the lower sealing module comprises an evacuating portion configured to evacuate a space below the film, said space below the film including the holding portion configured to receive the container, and maintain the vacuum while the cut-out area of film is sealed to the container. This will typically involve one or more apertures provided through the lower sealing module that connect through to a vacuum pump.

As mentioned above, the upper sealing module and cutting tool are mounted in an upper sealing tool and the lower sealing module is mounted in a lower sealing tool. Preferably, the upper sealing tool comprises a plurality of upper sealing modules and corresponding cutting tools, and the lower sealing tool comprises a corresponding plurality of lower sealing modules, such that a plurality of containers may be sealed simultaneously.

Preferably, the system further comprising a clamping plate configured to clamp the film to the upper sealing tool thereby defining an enclosed space above the film for said evacuating portion to evacuate, and further preferably the clamping plate has an aperture through which at least the upper sealing module can pass to bring the film into contact with a container in the holding portion of the lower sealing module. As described above, this facilitates the evacuation of the space above the film and allows the film to be drawn onto the evacuating portion of the upper sealing module. Further preferably, the lower sealing tool is configured to clamp to the clamping plate, or the clamping plate is a part of the lower sealing tool such that the film is clamped to the upper sealing tool by the lower sealing tool, thereby defining an enclosed space below the film including the holding portion of the lower sealing module.

Typically, in the recessed position, the cutting tool is recessed with respect to a lower face of the upper sealing tool and the upper sealing module such that a blade of the cutting tool may be retracted away from the film during evacuation of the space above the film. In other words, the lowermost point of the cutting tool, i.e. the blade, is located further from the lower sealing module than either the lower surface of the upper sealing tool or sealing portion of the upper sealing module. By recessing the cutting tool in this way, as the film is drawn upwards towards the sealing module by the evacuation of the space above the film, the upper sealing tool and upper sealing module will prevent the film from being drawn on to the blade of the cutting tool.

Preferably, the blade of the cutting tool is shaped to cut the film along a cutting profile, said cutting profile defining a smaller lateral area than the lateral area of the holding portion of the lower sealing module. That is, the shape of the blade will determine the shape of the cut-out area of the film and this shape is configured to be smaller than the container to which it is being sealed in order to provide the above-described "inside cut". Typically, the blade of the cutting tool will surround the upper sealing module such that the area of film is cut out by movement of the cutting tool towards the lower sealing module.

The cutting tool and the upper sealing module may be configured such that the cutting tool is slowed or stationary during the second movement so as to prevent the blade of the cutting tool from contacting a container being sealed. That is, the cutting tool is slowed or stopped so that the upper sealing module advances past the cutting tool once again in order to bring the film into contact with the container without the cutting tool also contacting the container.

Preferably, the heat sealing portion surrounds the evacuating portion such that the heat sealing portion is configured to simultaneously form said seal surrounding a product-receiving area of the container. The heat sealing portion may be, for examiner a downwardly-projecting rim of the upper sealing module which is heatable to a temperature for sealing the film to the container. This rim may be pressed against the film and container and so heat seal the film to the container.

As indicated above, preferably the upper sealing module and the cutting tool are each movably mounted relative to a common drive element, wherein movement of the drive element from a first position to a second position, preferably along a single direction from the first position to the second position, causes the cutting tool to move from the retracted position to the cutting position and causes the upper sealing module to move relative to the lower sealing module for sealing a cut out area of film to a container. The upper sealing module and the cutting tool may each be movably mounted relative to the common drive element so that they have different movable ranges, such that movement of the drive element from the first position to the second position causes the relative movement between the upper sealing module and the cutting tool in first movement phase. The upper sealing module and the cutting tool may each be movably mounted relative to the common drive element using resilient couplings, such as springs, in particular to accommodate the different movable ranges of the cutting tool and upper sealing module.

Typically, the film transport system comprises a supply spool for supporting and dispensing film from a roll of film and preferably a take-up spool for collecting film not cut out by the cutting tool.

BRIEF DESCRIPTION OF THE DRAWINGS

The invention will now be described with reference to the accompanying drawings of which.

DETAILED DESCRIPTION

An embodiment of a system for performing a skin sealing process will now be described with reference to FIGS. 1 to 7.

Figure 1:
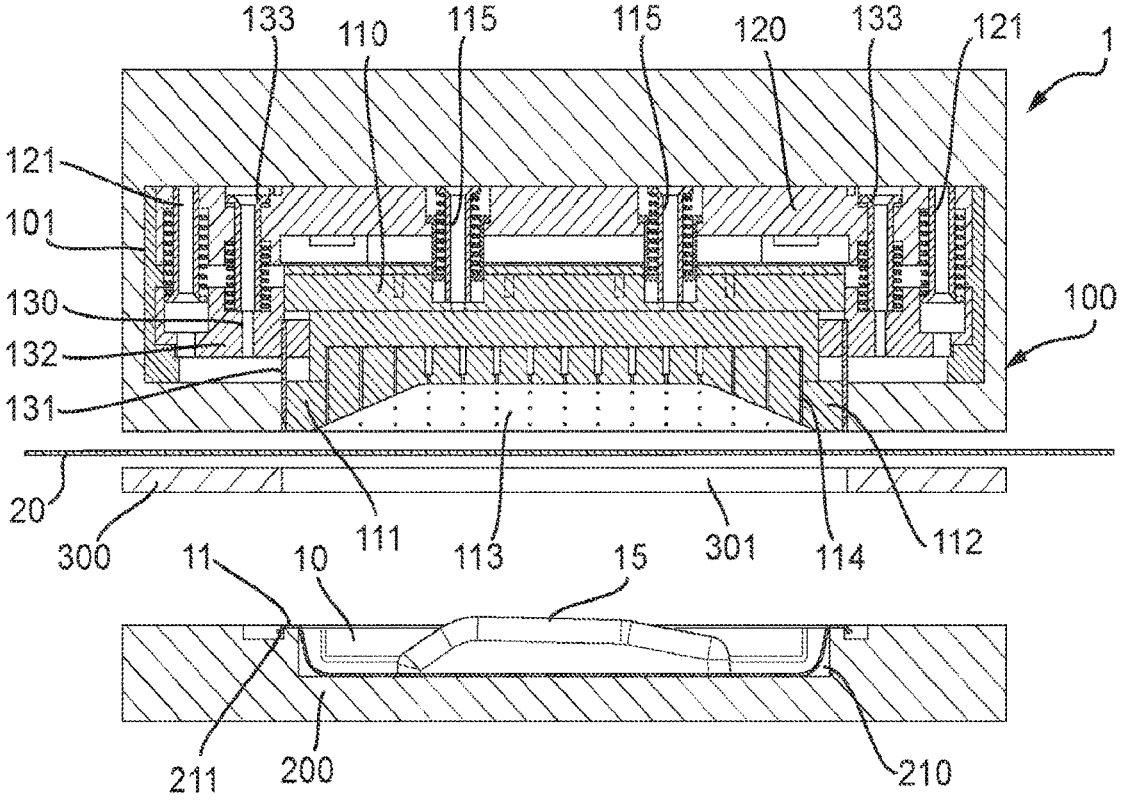
FIG. 1 shows, in schematic cross-section, a system for performing a skin sealing process at a first stage during the process.

FIG. 1 shows a system 1 for performing a skin sealing process after having been provided with a container to be sealed. The container 10 in this embodiment is a shallow tray having a rim 11 extending around the periphery of the tray. The tray has been provided with a product 15 substantially in the centre of the tray, so that the tray rim laterally surrounds the product. The product 15 may be, for example, a piece of meat, fish or poultry. In this embodiment the tray's depth is less than the height of the product 15 in order to minimise the height of the final sealed container and readily display the skin sealed product, although in other embodiments the tray could be deeper than the product placed therein, or the container could be a substantially flat sheet.

The tray 10 has been provided to a lower sealing module 210 of a lower sealing tool 200. The lower sealing tool is the frame in which the lower sealing module 210 is supported. In this embodiment, the lower sealing tool 200 supports only one lower sealing module 210, although an embodiment will be described below that contains multiple sealing modules. In this embodiment, the purpose of the lower sealing module is simply to hold the container in place while the upper sealing module 110 seals the film to the container 15. Accordingly, the lower sealing module 210 in this embodiment comprises a recessed area for receiving the tray. The lower sealing module 210 also comprises a supporting portion 211 for supporting the rim 11 of the tray 10. The supporting portion is formed by a ridge surrounding the recessed area of the lower sealing module that substantially matches the outline of the rim 11. When the tray 10 is located in the lower sealing module 210, the supporting portion contacts the lower side of the rim 11 about the entire circumference of the tray and ensures that the rim 11 does not flex away from the upper sealing module 110 as pressure is applied during sealing.

The upper sealing module 110 is located in an upper tool 100 positioned above the lower sealing tool 200. The upper tool 100 comprises a supporting frame that holds the upper sealing module 110 as well as a cutting tool 130 within a cavity 101 within the upper tool 100.

The upper sealing module 110 mounted within the upper tool 100 comprises a movable heater plate 111, which is powered to generate heat serving a number of purposes in the sealing process. The heater plate 111 has a lateral shape and size generally corresponding to the shape and size of a container 10. The lower surface of the heater plate 111, which faces the container to be sealed, has a periphery 112 configured to make contact with the rim 11 of the tray 10 in order to effect a seal of the film to the container. The lower periphery 112 of the heater plate (i.e. the heat sealing portion of the upper sealing module 110) is substantially level with the lower face of the upper tool 100 when the heater plate is in its starting position within the upper tool.

A central region 113 of the heater plate 111 has a generally concave shape, being raised away from the tray relative to the periphery 112 so as to not contact the product or tray as while the periphery seals the film to the rim 11 of the tray 10. The concave central region 113 of the heater plate 111 is provided with an array of openings 114 through the lower surface of the heater plate which serve to communicate air via a network of channels to a pump (not shown) connected to the system. This array of apertures enables the heater plate to also function to evacuate the space above the film, i.e. to act as an evacuating portion of the upper sealing module. As well as evacuating air, the array of openings 114 also allows the heater plate to blow air at the film below, which air may be heated by the heater plate in order to begin to warm the film in preparation for the sealing process.

The heater plate 111 is mounted on a pair of spring couplings 115 to a movable carriage 120 (which acts as a movable drive element for driving the motion of the heater plate) within the upper tool 100, which will be discussed further below.

Also mounted within the cavity 101 within the upper tool 100 is a cutting tool 130. The cutting tool comprises a blade 131 that extends entirely around the periphery of the heater plate 111 of the upper sealing module 110. The blade closely follows the periphery of the heater plate 111 so that the area of film that is cut out during the skin sealing process is only slightly larger than the area of the heater plate periphery 112 which defines the position of the seal, and so the film will be only slightly larger than the area encompassed by the seal. Notably, this means that there may be very little excess film, i.e. that which extends beyond the location of the seal, so that there may be substantially no film extending beyond the edge of the rim 11 of the tray 10.

The blade 131 of the cutting tool 130 is mounted to a cutting tool carriage 132 within the cavity 101 of the upper tool 100, which is movable between a raised and lowered position in order to move the blade of the cutting tool from a retracted position, at which it is recessed within the upper tool 100, to a cutting position for cutting the film, which will be described in more detail later. In particular, when the cutting tool carriage is in the raised starting position, the lower edge of the blade 131, i.e. the part that cuts the film, is retracted into the gap between the lower face of the upper tool 100 and the heater plate periphery 112 so that the film cannot come into contact with the blade.

The carriage 120 is responsible for causing the cutting blade 131 and the heater plate 111 to move to effect cutting and sealing of the film. The carriage 120 is mounted to the ceiling of the cavity 101 within the upper tool 100 by a pair of spring couplings 121. These spring couplings comprise a shaft that passes through the carriage 120 and whose upper side fixedly connects to the ceiling of the cavity 101. The flanged base of the shaft of the spring coupling connects to the lower end of a spring and the upper end of the spring connects to the carriage 120. The carriage 120 initially sits in contact with the ceiling of the cavity 101 and movement of the carriage downwards, e.g. generated by pneumatic drive (not shown) causes the spring to be compressed between the carriage and the lower end of the shaft of the spring coupling 121. This provides a restorative force that returns the carriage to its raised position when the carriage is no longer being urged downwards.

The cutting tool carriage 132 is mounted to the carriage 120 by a pair of spring couplings 133. Each spring coupling 133 again comprises a spring mounted around a shaft. In these couplings, the lower end of the shaft is fixed to the cutting tool carriage 132 and the shaft passes through the carriage 120 with the flanged top of the shaft being fitted within a recess in the upper face of the carriage 120. A spring within the spring coupling 133 extends between the base of the shaft where it fixes to the cutting tool carriage 132 and a recess within the lower face of the carriage 120. The tension of the spring ensures that movement of the carriage 120 downwards from its initial position causes the cutting tool carriage 132 to move downwards as well, and hence causes the blade 131 to move towards its cutting position. Once the cutting blade 131 has reached the cutting position, further movement is arrested by the cutting tool carriage 132 coming into contact with the floor of the cavity 101 within the upper tool. This can be seen in FIG. 5. The floor of the cavity 101 within the upper tool restricts the motion of the cutting blade and prevents the cutting blade from continuing downwards and coming into contact with the container during use. While the cutting tool carriage 132 is arrested by contact with the cavity floor, the carriage 120 is able to continue its downward movement, as it now compresses the spring couplings 133 that connect it to the cutting tool carriage.

The further movement of the carriage 120, once the movement of the cutting tool has been arrested, causes the heater plate 111 to be moved downwards. As mentioned above, the heater plate 111 is connected to the carriage 120 by its own pair of spring couplings 115. Each spring coupling includes a shaft whose base is fixed to an upper side of the heater plate 111 and which passes through the carriage 120. A flanged upper end of each shaft is connected to an upper end of a respective spring. The lower end of each spring is connected to a collar insert, which is fixed to the carriage 120. When the carriage is in its raised starting position, the spring of the spring couplings 115 is compressed, which urges the heater plate 111 upwards by acting on the flanged upper end of the shaft. As the carriage begins to move downwards from its starting position, the springs in the spring couplings 115 begin to decompress while the heater plate 111 remains in its fully raised position. When the carriage 120 reaches approximately the point the cutting tool is arrested, a lower face of the carriage engages the upper side of the heater plate 111 and begins to push this down, out from the lower face of the upper tool 100 and towards the tray 10. This can be seen in FIG. 5.

The system further comprises a clamping plate 300 positioned between the upper and lower tools 100, 200, which, in use, will clamp the film 20 to the lower surface of the upper tool 100 in order to define an enclosed space above the film in which the upper sealing module 110 and the cutting tool 130 are located. The clamping plate is formed by a substantially flat plate having an aperture 301 therethrough. The clamping plate may extend beyond the edge of the upper and lower tools in direction perpendicular to the feed direction of the film, where is may be coupled to a lifting device for moving the clamping plate 300 up and down. The shape and size of the aperture 301 is slightly larger than the shape and size of the heater plate 111 and cutting blade 131. In use, the upper face of the clamping plate will be clamped to the lower face of the upper tool 100 with the aperture aligned with the upper sealing module and cutting tool. The aperture thereby enables both the cutting blade 131 and the heater plate to advance out of the upper tool 100 and towards the tray even when the clamping plate is in position, clamped to the upper tool.

In addition to clamping film 20 to the lower surface of the upper tool 100, the lower 200 tool can be clamped to the lower face of the clamping plate 300. This further defines an enclosed space below the film containing the container 10 and product 15. In order to clamp to the clamping plate, the lower tool 200 may be lifted by a lifting device (not shown) located below the lower tool.

Figure 9:
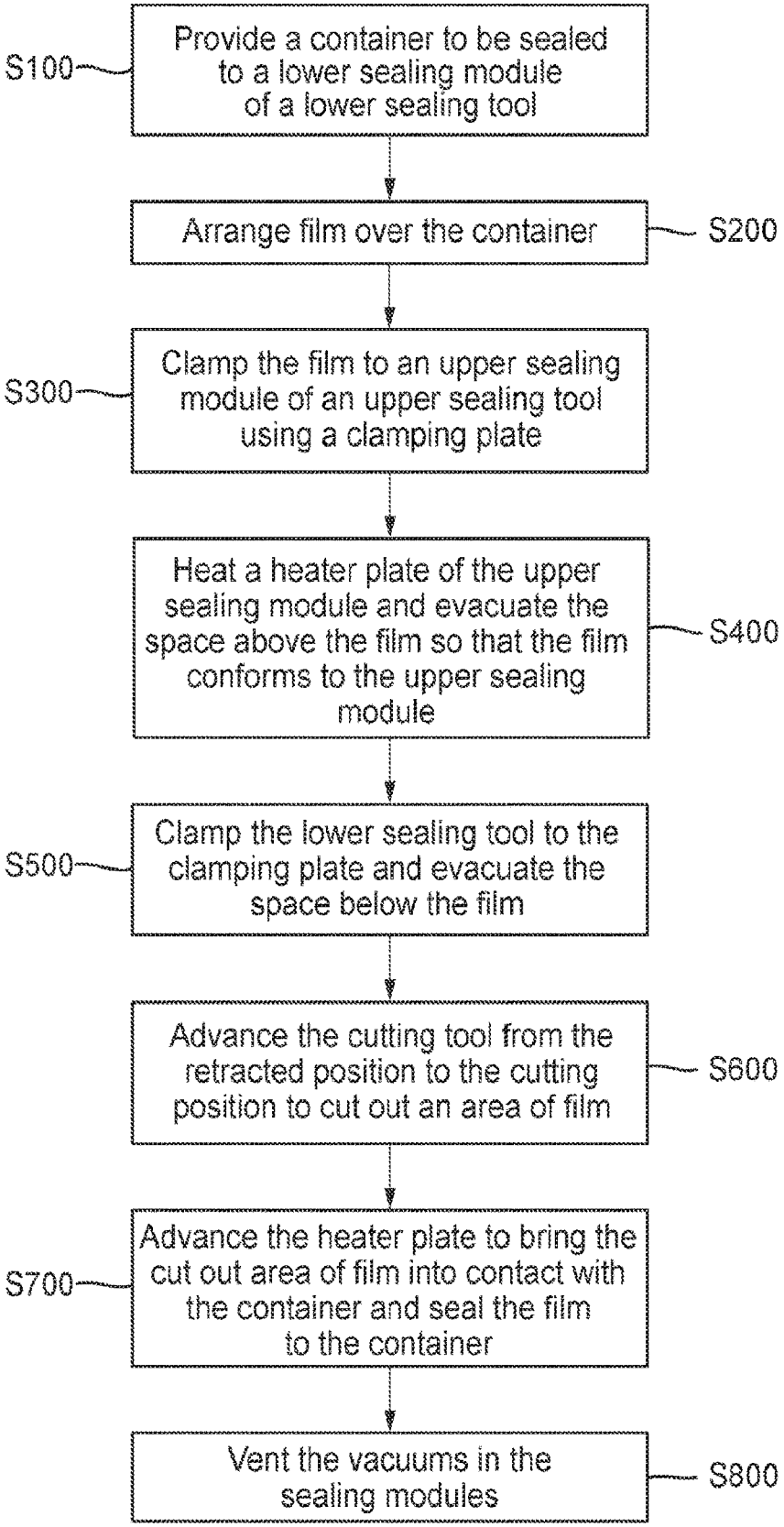
FIG. 9 is a flow diagram illustrating the steps of the skin sealing process performed by the system of FIG. 1.

A method of skin sealing that may be performed using this system will now be described with further reference to FIG. 9.

In step S100, a container 10 holding a product 15 is provided to the lower sealing module 210 of the lower tool. The container is positioned as described above, with the rim 11 of the tray 10 being supported by the supporting portion 211 of the lower sealing module 210 and with the body of the tray being received in the recessed area of the lower sealing module 210. The tray 10 may be provided to the lower sealing module 210 by any suitable container transport system while the sealing tools 100, 200 are in an open configuration, as shown in FIG. 1, and while the clamping plate is spaced from both the upper and lower tools.

In step S200, film 20 is arranged over the container. While this step is indicated as taking place after step S100, the film may be arranged over the lower sealing module 210 while the container is being transported to the lower sealing module. In this embodiment, the film is fed between the clamping plate 300 and the upper tool 100 by a film transport system, which comprises an upstream spool that holds a continuous web of film and from which the film is unwound and passed through the system before waste film is rewound on a downstream waste film spool. The film transport system is not shown in this embodiment, but an example can be seen in FIG. 8 in the context of a system comprising multiple sealing modules in each tool. As noted above, the film is arranged between the clamping plate 300 and the upper tool 100. The film covers an area greater than the size of the opening into the upper tool 100 so that there is enough film to completely cover the upper sealing module for producing a complete seal of the container during the skin sealing process.

Figure 2:
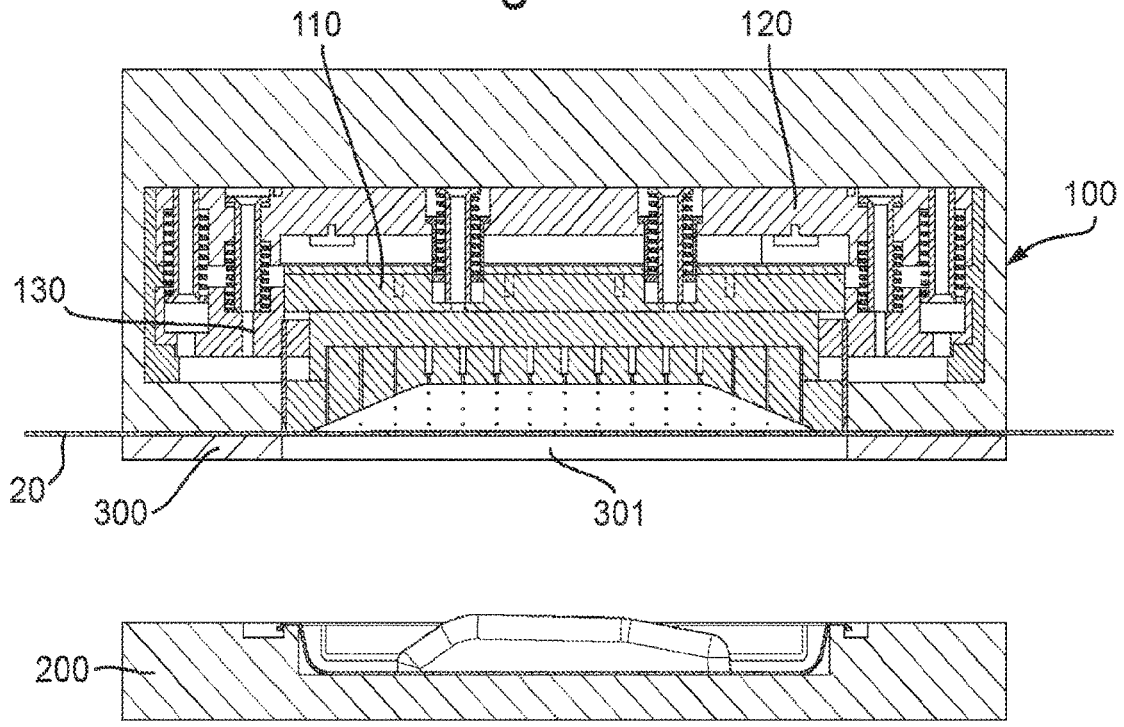
FIG. 2 shows, in schematic cross-section, the system of FIG. 1 at a second stage during the skin sealing process.

In step S300, the clamping plate 300 clamps the film 20 to the upper tool 100. This is shown in FIG. 2. As mentioned above, the opening 301 through the clamping plate 300 is aligned with the cutting blade 131 and the heater plate 111.

This clamps the film about the entire periphery of the opening into the cavity 101 in the upper tool 100, in which the upper sealing module 110 and the cutting tool 130 are located. This forms an enclosed space above the film 20, inside the upper tool 100.

Figure 3:
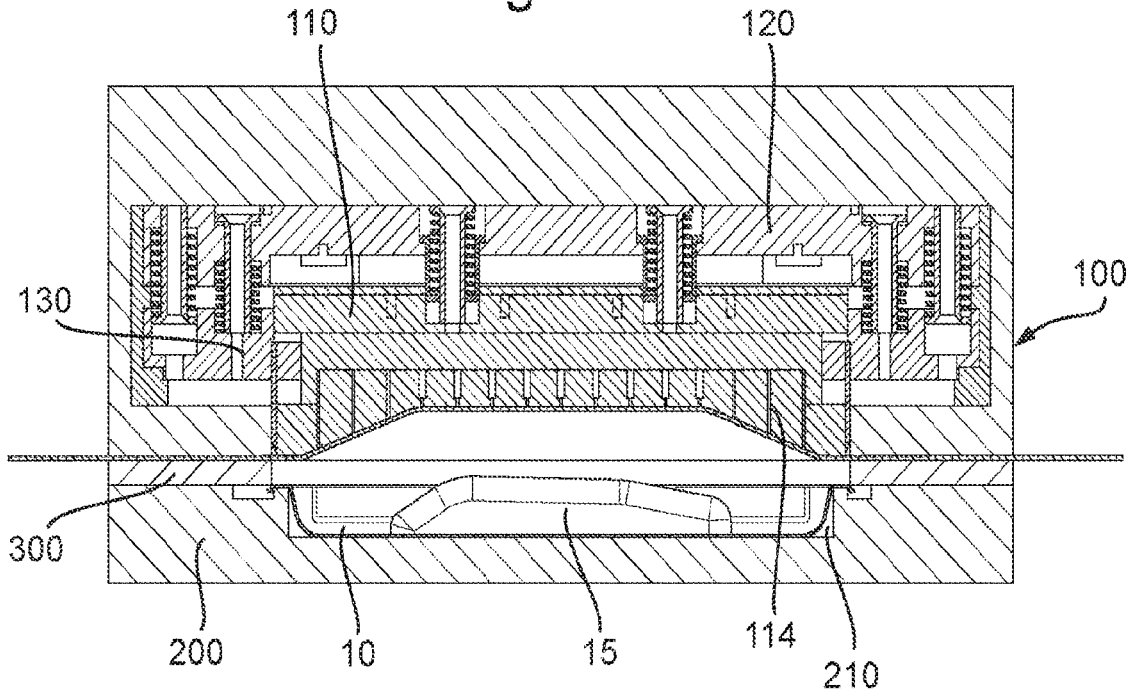
FIG. 3 shows, in schematic cross-section, the system of FIG. 1 at a third stage during the skin sealing process.

In step S400, the heater plate 111 is heated, which heats the film clamped below the heater plate. In practice, the heater plate may already be hot from a previous skin seal process or may have been preheated before the film is clamped to the upper tool 100. The upper sealing module 110 then evacuates the space above the film by using the array of openings 114 through the heater plate, which are in fluid communication with a vacuum pump (not shown). This evacuation of the space above the film 20 draws the film onto the heater plate 111, as shown in FIG. 3. Notably, during this evacuation process, the blade 131 of the cutting tool is located in its recessed position. That is, the cutting tool carriage 132 is in its raised starting position so that the blade 131 is retracted up in the gap between the edge of the opening in the lower face of the upper tool 100 and the lower periphery 112 of the heater plate 111. Accordingly, even when the film is drawn upwards towards the heater plate 111 and blade 131, it is not pulled onto the blade 131, which would cause damage to the film.

In step S500, the lower tool 200 is clamped to the lower side of the clamping plate 300 to form an enclosed space below the film 20 in which the container and product to be sealed are located. This clamped position of the lower tool 200 is also shown in FIG. 3. In order to effect the clamped position of the lower tool 200, the lower tool may be raised by a lifting unit (not shown) located below the tool in order to press the lower tool upwards against the lower side of the clamping plate. This forms an enclosed space in the lower sealing module 210, below the film, including the tray 10 and the product 15. Optionally, the enclosing of the space below the film may be facilitated by the provision of a sealing member (not shown), such as a rubber seal surrounding the area of the tray 10, in the lower face of the clamping plate 300 or the upper face of the lower tool 200. Once the space below the film including the container 10 is enclosed, the space may be evacuated so that the container is held in a vacuum. The vacuum may be generated by one or more channels connecting into the lower sealing module 210 that are provided in fluid communication with a vacuum generating pump (not shown). It should be noted that the vacuum pressure applied to the space below the film should not be great enough to overcome the vacuum pressure holding the film against the heater plate 111.

Figure 4:
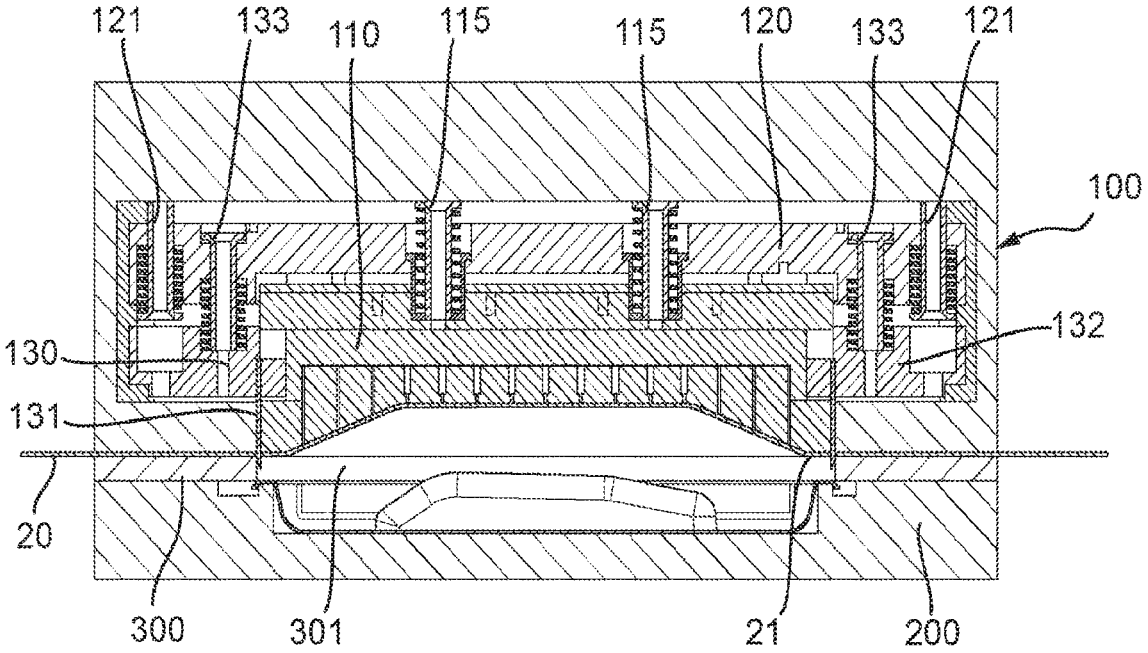
FIG. 4 shows, in schematic cross-section, the system of FIG. 1 at a fourth stage during the skin sealing process.

Next, in step S600, the cutting tool 130 is advanced from the retracted position to the cutting position to cut out an area of film 21. The cutting tool in the cutting position is shown in FIG. 4. As noted above, this movement is provided by moving the carriage 120 downward from its raised starting position, e.g. by operation of a pneumatic drive. This movement of the carriage 120 compresses the spring couplings 121 connecting the carriage to the ceiling of the cavity 101, which provide a restorative force on the carriage, tending to move it back towards its starting position, e.g. if the pneumatic drive fails. This downward movement simultaneously urges the cutting tool carriage 132 downwards via the spring couplings 133, thereby causing the cutting blade 131 to move down from its retracted position. In particular, the cutting blade 131 is moved to a position at which it protrudes below the lower face of the upper tool 100 and below the lower periphery 112 of the heater plate 111 and extends into the opening 301 through the clamping plate. In this position, the cutting blade 131 has been forced through the film 20, which is clamped to the upper tool 100 and which is conformed to the heater plate 111 by the evacuation of the space above the film. Since the cutting blade extends closely around the entire periphery of the heater plate 111, this motion of the cutting blade cuts out an area of film 21 that closely matches the area of the heater plate 111. Here it will be appreciated that the film 20 should extend some distance beyond the sides of the heater plate 111 in a direction perpendicular to the feed direction of the film so the film it not cut across the entire width of the web. This will enable the waste film to be wound on to a waste spool, which in turn provides a mechanism for advancing the film web for a subsequent skin seal process.

It will be noted that the initial downward movement of the carriage 120 that causes the cutting tool 130 to move to the cutting position does not cause the heater plate 111 to move. In particular, this is because the carriage 120 is initially spaced from the heater plate 111 and the spring couplings 115 are initially compressed so that the heater plate 111 continues to be urged upwards and kept in its fully raised position even as the carriage 120 moves downwards and the spring couplings begin to decompress.

Figure 5:
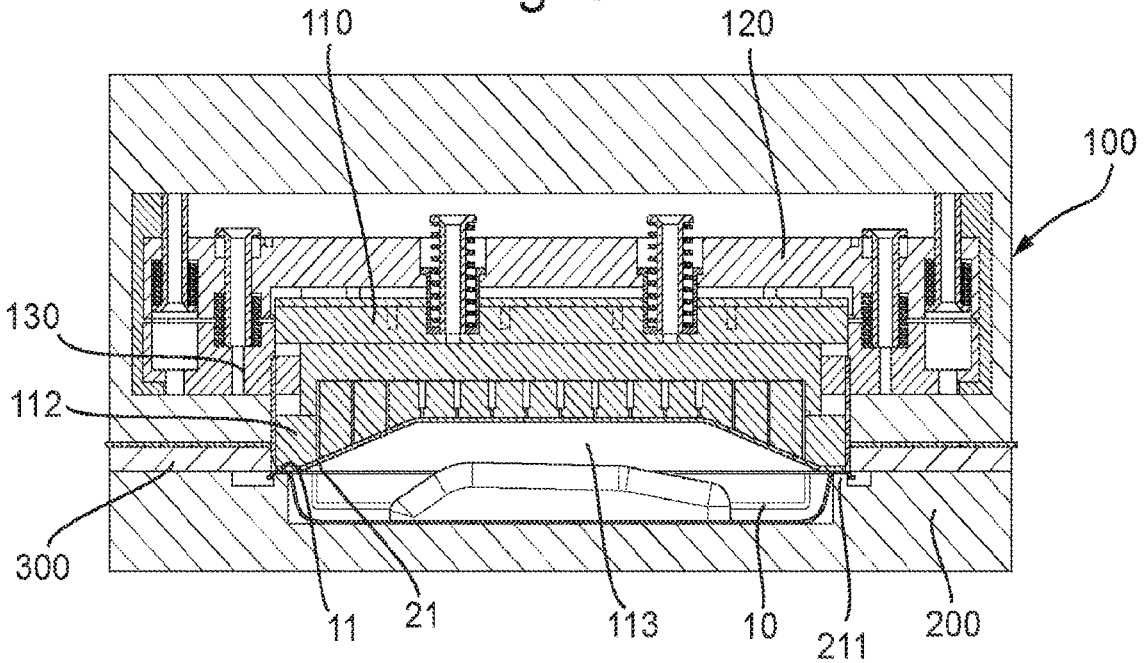
FIG. 5 shows, in schematic cross-section, the system of FIG. 1 at a fifth stage during the skin sealing process.

In step S700, the heater plate is advanced to bring the cut out area of film 21 into contact with the container. This final sealing position of the heater plate is shown in FIG. 5. As the carriage 120 continues to move from its position in FIG. 4, at which the cutting tool has been moved to the cutting position, the cutting tool carriage comes into contact with the floor of the cavity 101 inside the upper tool 100. This prevents further downward movement of the cutting tool 130 and hence the cutting blade 131 and so stops the cutting blade from advancing any further towards the container. Now, rather than moving with the carriage 120, the cutting tool remains stationary and the springs of the spring couplings 133 begin to compress in order to allow the carriage 120 to move relative to the cutting tool. The range of motion of the cutting blade will be configured to ensure that the film has been completely cut by the blade 131 but the blade has not been brought into contact with the rim 11 of the tray 10.

At substantially the same point that the cutting tool 130 is stopped from further movement by the floor of the cavity 101, the carriage 120 comes into contact with the rear of the heater plate 111. Now that the carriage is engaged with the rear of the heater plate, further downward movement of the carriage 120 also causes the heater plate 111 to move downwards and towards the tray 10. The carriage 120 continues to move until the heater plate 111, carrying the cut out area of film 21, passes through the opening 301 in the clamping plate 300 and is brought into contact with the tray 10. In particular, the downward movement of the heater plate 111 moves the lower periphery 112 of the heater plate so that it presses an edge region of the cut out area of film 21 into contact with the rim 11 of the tray. At this point, the supporting portion 211 of the lower sealing module 210 supports the rim of the tray so that high pressure and temperature are generated where the periphery 112 of the heater plate 111 presses the film 21 into contact with the tray rim 11. The heat and pressure applied to the film 21 and tray rim 11 causes the film 21 to fuse to the tray rim 11 about the entire periphery of the tray 10. At this point, the edge of the film is sealed to the tray, while the centre of the cut out area of film 21 is still held under vacuum pressure in contact with the concave centre area 113 of the heater plate 111. Thus, the product 15 located inside the container 10 is now sealed inside the container under vacuum conditions.

Figure 6:
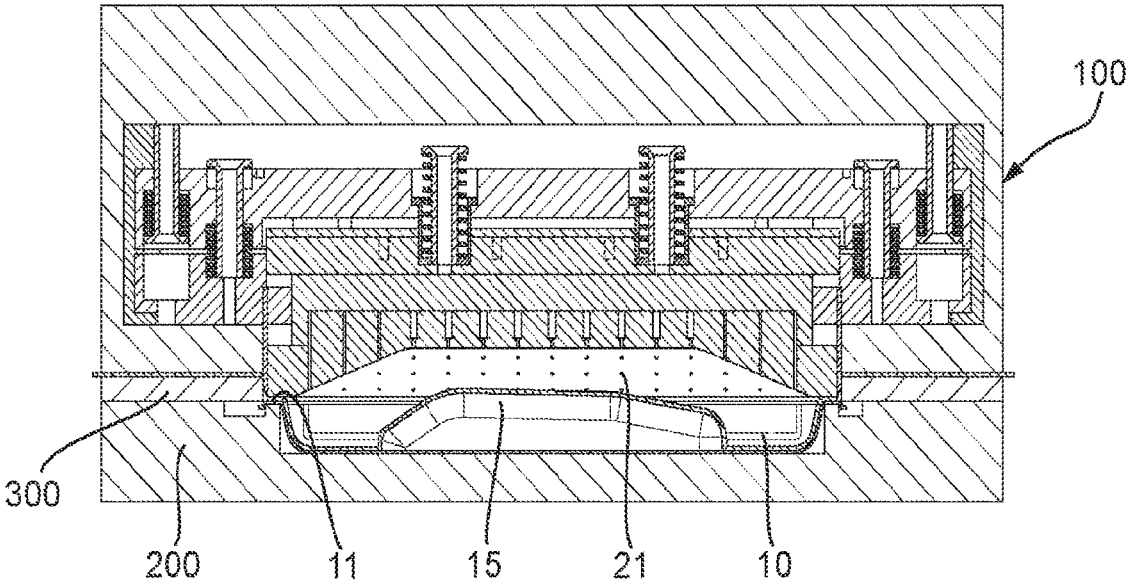
FIG. 6 shows, in schematic cross-section, the system of FIG. 1 at a sixth stage during the skin sealing process.

In step S800, the vacuums in the sealing modules 110, 210 may be vented. The relative absence of air sealed inside the container thus causes the heated film to be pulled down from the heater plate 111 and onto the container where it now conforms to the shape of the product 15 located in the container 10. This is shown in FIG. 6. This provides the final skin seal appearance of the sealed container.

Figure 7:
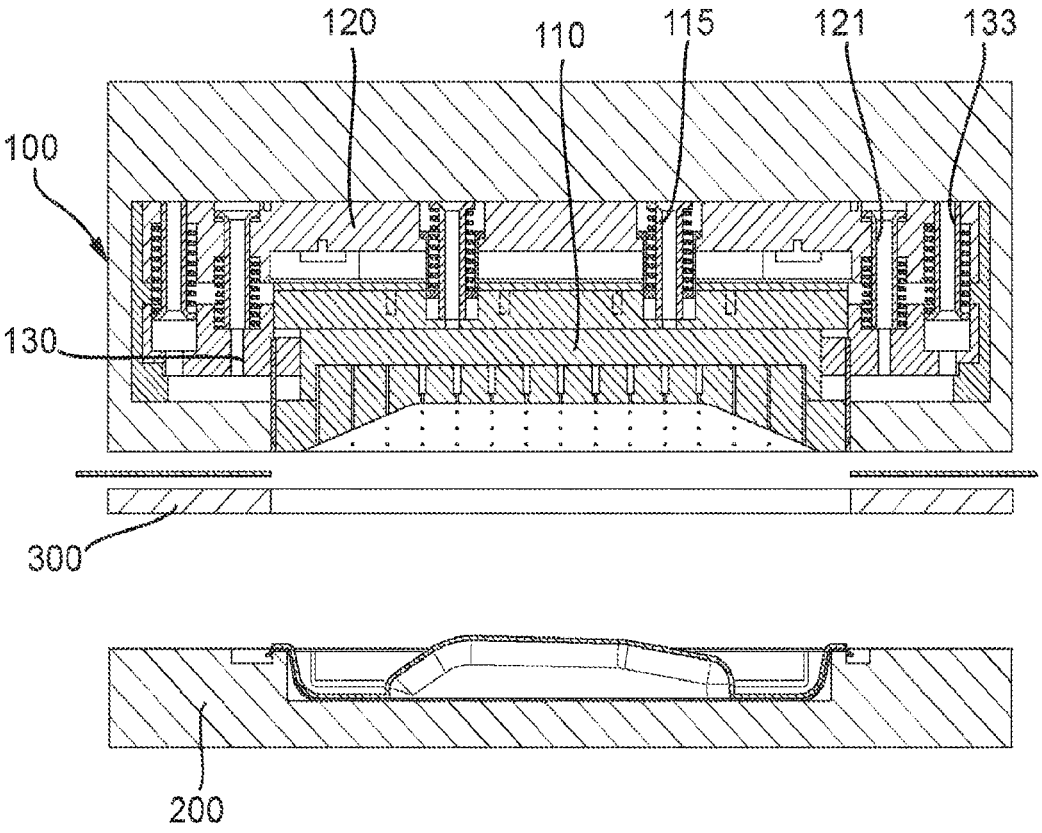
FIG. 7 shows, in schematic cross-section, the system of FIG. 1 having completed the skin sealing process.

Now that the skin seal process is completed, as shown in FIG. 7, the tools 100, 200 and clamping plate 300 may be separated from one another and the carriage 120, cutting tool 130 and heater plate 111 of the upper sealing module 110 are returned to their starting position by the action of the spring couplings 115, 121 and 133. The skin sealed container may then be removed from the lower sealing module 210 and transported downstream for further packaging or labelling. The waste film 20 may then be wound on to bring a new area of film into place and a new container 10 provided to the now empty lower sealing module 210 so that the process may be performed again for a subsequent container.

Figure 8:
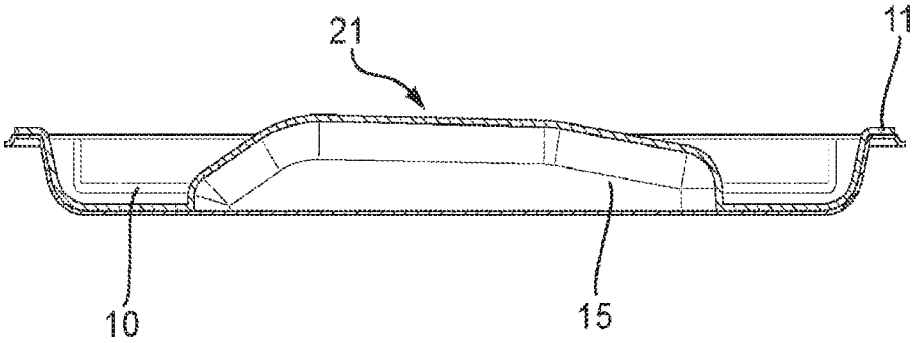
FIG. 8 shows, in schematic cross-section, the final skin sealed container output from the system of FIG. 1.

FIG. 8 show the final skin sealed container 10 in cross-section. As shown in this Figure, by performing this process by cutting and then sealing the film to the tray 10, the cut out area of film 21 may be sized slightly smaller than the lateral size of the tray 10 defined by the edge of the rim 11. Therefore, the film does not extend beyond the rim of the tray, providing a so-called inside cut appearance to the skin sealed container.

In the above description of the system shown in FIGS. 1 to 7, the cutting and sealing performed by the system has been described by referring to movement of the carriage 120 within a stationary upper tool 100 held over a stationary lower tool 200. However, the same relative motions within the sealing process could also be achieved by moving the entire upper tool 100 and lower tool 200 upwards, while the carriage 120 is held stationary, e.g. by a coupling through the upper tool to the frame of the sealing system.

Figure 10:
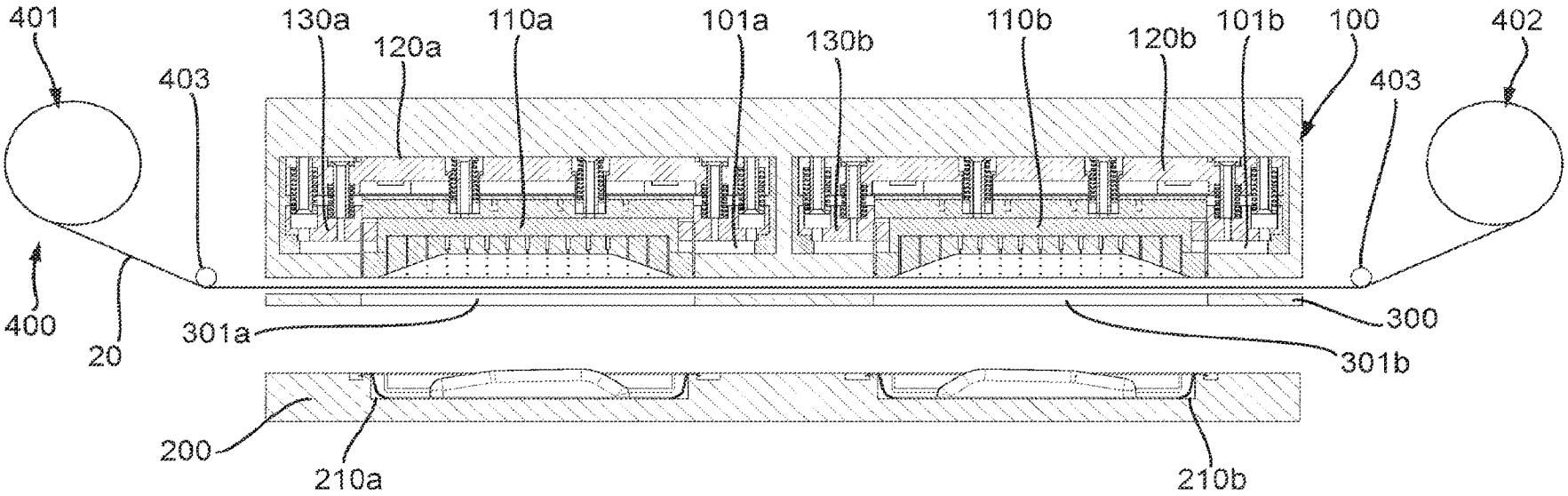
FIG. 10 shows, in schematic cross-section, a system containing multiple sealing modules for performing multiple simultaneous skin sealing processes.

FIG. 10 shows another system for performing a skin sealing process, this time fitted with multiple sets of sealing modules for performing multiple simultaneous skin seal processes.

In this embodiment, one common upper tool 100 and one common lower tool 200 define two separate sealing stations, in this case spaced from one another along the process direction. In other embodiment, the sealing stations could be spaced across the process direction, and typically more than two sealing stations will be provided and these may involve a two dimensional spacing of sealing stations.

Each sealing station is substantially as described above with respect to FIG. 1 7. That is, the first sealing station comprises an upper sealing module 110*a*, a carriage 120*a*, and a cutting tool 130*a* located in a first cavity 101*a* inside the upper tool, and a lower sealing module 210*a* located in the lower tool. The second sealing station, located further along the processing direction, likewise comprises an upper sealing module 110*b*, a carriage 120*b*, and a cutting tool 130*b* located in a second cavity 101*b* inside the upper tool, and a lower sealing module 210*b* located in the lower tool. The system is also provided with one clamping plate 300, which comprises a first opening therethrough 301*a* that aligns with the first upper sealing module 110*a* and cutting tool 130*a*, and a second opening 301*b* spaced along the process direction of the system that aligns with the second upper sealing module 110*b* and cutting tool 130*b*.

In use, each sealing station will perform its own skin seal process on a respective container located in the lower sealing module 210*a*, 210*b*. This process will be the same as described above with respect to FIGS. 1 to 8.

FIG. 10 also shows a film transport system 400 for arranging the film 20 over the containers located in the tools. The transport system 400 comprises a supply spool 401 about which a supply of film 20 is wound. Film is unwound from this supply spool 401 and passed through the system, between the upper tool 100 and the clamping plate 300, where it is coupled to a take-up spool 402. The position and orientation of the film through the system is controlled by a pair of feed rollers 403, which ensure that the film is substantially level as it is passed between the upper tool 100 and the clamping plate 300. In use, the supply spool 401 is unwound and the take-up spool wound to move the film through the system. After a skin sealing process is performed, areas of the film will have been cut out, and so the transport system 400 will advance the film so that a fresh area of film is located at each sealing station, and the waste film will be taken up by the take-up spool.

The invention claimed is:

1. A method of sealing a container with a film cover, the method comprising:

providing the container having a product in a product-receiving area of the container and having a sealing area of the container surrounding the product-receiving area;

arranging a length of film over the container;

using an upper sealing module arranged over the film, evacuating a space above the film using an evacuating portion of the upper sealing module so as to cause a portion of the film to conform to the upper sealing module;

using a cutting tool, cutting out an area of the film by moving the cutting tool relative to the upper sealing module from a recessed position to a cutting position, wherein the cut-out area of film includes the portion of the film conformed to the upper sealing module, wherein a blade of the cutting tool surrounds the upper sealing module such that the area of film is cut out by relative movement of the cutting tool along a direction substantially perpendicular to the film;

bringing the cut-out area of film into contact with the sealing area of the container by moving the upper sealing module relative to the container; and sealing the cut-out area of film to the sealing area of the container using a heat sealing portion of the upper sealing module; characterized in that the movement of the cutting tool and the upper sealing module comprises three distinct phases, wherein in a first movement phase the cutting tool is moved relative to the upper sealing module, in a second movement phase the cutting tool and the sealing module move together towards the container, and in a third movement phase the upper sealing module is moved to bring the cut-out area of film into contact with the sealing area of the container and the cutting tool is slowed or stopped relative to the container so that the blade of the cutting tool does not contact the container.

2. A system for sealing a container with a film cover, the system comprising:

a lower sealing module configured to receive the container to be sealed in a holding portion;

a film transport system configured to arrange a length of film over the container received in the lower sealing module;

an upper sealing module comprising an evacuating portion and a heat sealing portion, the evacuating portion being configured to evacuate a space above the film so as to cause a portion of the film to conform to the upper sealing module and the heat sealing portion being configured to heat seal the film to the container received in the lower sealing module so that the seal surrounds a product-receiving area of the container;

and a cutting tool configured to cut around the upper sealing module so as to cut out an area of the film including the portion conformed to the upper sealing module for sealing to the container, wherein the cutting tool is movable relative to the upper sealing module between a retracted position and a cutting position;

wherein the cutting tool and the upper sealing module are each movable relative to the lower sealing module, wherein in a first movement phase the cutting tool is movable relative to the upper sealing module from the retracted position to the cutting position for cutting out the area of film, in a second movement phase the cutting tool and the upper sealing module are movable together towards the lower sealing module, and in a third movement phase the upper sealing module is movable relative to the lower sealing module for sealing the film to the container and the cutting tool is slowed or stopped relative to the lower sealing module so that the blade of the cutting tool does not contact the container.

3. A system according to claim 2, wherein the evacuating portion of the upper sealing module comprises a heater plate for heating the film before and/or during evacuation of the space above the film.

4. A system according to claim 2, wherein the lower sealing module comprises an evacuating portion configured to evacuate a space below the film, said space below the film including the holding portion configured to receive the container, and maintain the vacuum while the cut-out area of film is sealed to the container.

5. A system according to claim 2, wherein the upper sealing module and cutting tool are mounted in an upper sealing tool and the lower sealing module is mounted in a lower sealing tool.

6. A system according to claim 5, wherein the upper sealing tool comprises a plurality of upper sealing modules and corresponding cutting tools, and the lower sealing tool comprises a corresponding plurality of lower sealing modules, such that a plurality of containers are sealed simultaneously.

7. A system according to claim 5, further comprising a clamping plate configured to clamp the film to the upper sealing tool thereby defining an enclosed space above the film for said evacuating portion to evacuate, wherein the clamping plate has an aperture through which at least the upper sealing module passes to bring the film into contact with the container in the holding portion of the lower sealing module.

8. A system according to claim 7, wherein either the lower sealing tool is configured to clamp to the clamping plate, thereby defining an enclosed space below the film including the holding portion of the lower sealing module, or the clamping plate is a part of the lower sealing tool such that the film is clamped to the upper sealing tool by the lower sealing tool, thereby defining an enclosed space below the film.

9. A system according to claim 5, wherein in the retracted position the cutting tool is recessed with respect to a lower face of the upper sealing tool and the upper sealing module such that a blade of the cutting tool is retracted away from the film during evacuation of the space above the film.

10. A system according to claim 2, wherein a blade of the cutting tool is shaped to cut the film along a cutting profile, said cutting profile defining a smaller lateral area than the lateral area of the holding portion of the lower sealing module.

11. A system according to claim 2, wherein a blade of the cutting tool surrounds the upper sealing module such that the area of film is cut out by movement of the cutting tool towards the lower sealing module.

12. A system according to claim 2, wherein the heat sealing portion surrounds the evacuating portion such that the heat sealing portion is configured to simultaneously form said seal surrounding a product-receiving area of the container.

13. A system according to claim 2, wherein the upper sealing module and the cutting tool are each movably mounted to a common drive element, wherein movement of the drive element from a first position to a second position, along a single direction from the first position to the second position, causes the cutting tool to move from the retracted position to the cutting position and causes the upper sealing module to move relative to the lower sealing module for sealing the cut out area of film to the container.

14. A system according to claim 13, wherein the upper sealing module and the cutting tool are each movably mounted to the common drive element so that they have different movable ranges, such that movement of the drive element from the first position to the second position causes the relative movement between the upper sealing module and the cutting tool in the first movement phase.

15. A system according to claim 14, wherein the upper sealing module and the cutting tool are each movably mounted relative to the common drive element so that they have different movable ranges, such that movement of the drive element from the first position to the second position causes the first movement phase in which the cutting tool advances in the direction towards the lower sealing module relative to the upper sealing module then causes the second movement phase in which the cutting tool and the upper sealing module are movable together towards the lower sealing module, and then causes the third movement phase in which the upper sealing module advances in the direction towards the lower sealing module relative to the cutting tool and the cutting tool is slowed or stopped relative to the lower sealing module.

16. A system according to claim 13, wherein in the first position, the common drive element is spaced from the upper sealing module and/or the upper sealing module is mounted via one or more resiliently deformed resilient couplings which act to urge the upper sealing module away from the lower sealing module during the first movement phase as the common drive element moves from the first position to the second position.

17. A system according to claim 13 wherein during the movement of the common drive element from the first position to the second position, the cutting tool moves relative to one or more stopping elements during the first movement phase, said relative movement causing the cutting tool to engage the one or more stopping elements, which thereby inhibit further relative movement of the cutting tool during the third movement phase as the common drive element moves from the first position to the second position, wherein the one or more stopping elements engage a support member of the cutting tool, which carries the blade of the cutting tool, and wherein the cutting tool is mounted via one or more resilient couplings which resiliently deform as the common drive element moves during the third movement phase and movement of the cutting tool is inhibited by the one or more stopping elements.

18. A system according to claim 13, wherein the upper sealing module and the cutting tool are each movably mounted to the common drive element using resilient couplings.

19. A system according to claim 2, wherein the film transport system comprises a supply spool for supporting and dispensing film from a roll of film and further comprising a take-up spool for collecting film not cut out by the cutting tool.

* * * * *